US010544662B2

(12) United States Patent
Ding et al.

(10) Patent No.: US 10,544,662 B2
(45) Date of Patent: Jan. 28, 2020

(54) HYDRAULICALLY ACTUATED DOUBLE-ACTING POSITIVE DISPLACEMENT PUMP SYSTEM FOR PRODUCING FLUIDS FROM A DEVIATED WELLBORE

(71) Applicant: PMC PUMPS INC., Calgary (CA)

(72) Inventors: Yuchang (Bob) Ding, Calgary (CA); Xuefeng (Kevin) Ding, Calgary (CA)

(73) Assignee: PMC PUMPS INC., Calgary (CA)

( * ) Notice: Subject to any disclaimer, the term of this patent is extended or adjusted under 35 U.S.C. 154(b) by 239 days.

(21) Appl. No.: 15/833,905

(22) Filed: Dec. 6, 2017

(65) Prior Publication Data

US 2018/0156015 A1 Jun. 7, 2018

Related U.S. Application Data

(60) Provisional application No. 62/430,717, filed on Dec. 6, 2016.

(51) Int. Cl.

| | |
|---|---|
| ***E21B 43/12*** | (2006.01) |
| ***F04B 47/08*** | (2006.01) |
| ***F04B 9/113*** | (2006.01) |
| ***F04B 53/14*** | (2006.01) |
| ***E21B 43/24*** | (2006.01) |

(Continued)

(52) U.S. Cl.

CPC ..... *E21B 43/129* (2013.01); *E21B 36/001* (2013.01); *E21B 43/2406* (2013.01); *F04B 9/113* (2013.01); *F04B 47/08* (2013.01); *F04B 49/035* (2013.01); *F04B 49/065* (2013.01); *F04B 53/10* (2013.01); *F04B 53/143* (2013.01)

(58) Field of Classification Search

CPC ..... E21B 43/129; F04B 9/113; F04B 47/08; F04B 49/035; F04B 49/065; F04B 53/10; F04B 53/143; F04C 13/008

See application file for complete search history.

(56) References Cited

U.S. PATENT DOCUMENTS 5,941,305 A * 8/1999 Thrasher ..... E21B 43/121 166/53
6,004,114 A * 12/1999 Cunningham ..... E21B 43/129 166/105

(Continued)

FOREIGN PATENT DOCUMENTS

CA 2258237 1/1999

*Primary Examiner* — Patrick Hamo
(74) *Attorney, Agent, or Firm* — Bennett Jones LLP

(57) ABSTRACT

A submersible, hydraulically actuated, multi-stage double-acting positive displacement pump system is provided. The system has a hydraulically actuated reciprocating linear double-acting motor centrally disposed between and connected to double-action fluid pumps on either side of the motor, with pistons of each of pump and the motor all in the annular space between an inner wall of the apparatus' cylindrical body and the outer wall of a cylindrical production fluid conduit concentrically disposed within the body, to pump wellbore fluid from outside the assembly through the pumps and into the central production fluid conduit. The rate and direction of hydraulic fluid flow through the actuator may be controlled by VFD motors and PLC controller on the ground, and through at least one electromechanical valve and two limit switches mounted to the downhole components.

11 Claims, 8 Drawing Sheets

(51) Int. Cl.

| | |
|---|---|
| ***F04B 49/06*** | (2006.01) |
| ***F04B 49/035*** | (2006.01) |
| ***E21B 36/00*** | (2006.01) |
| ***F04B 53/10*** | (2006.01) |

(56) References Cited

U.S. PATENT DOCUMENTS

| | | | | |
|---|---|---|---|---|
| 6,454,010 | B1 * | 9/2002 | Thomas | E21B 17/18 166/105 |
| 6,623,252 | B2 * | 9/2003 | Cunningham | E21B 43/129 166/106 |
| 8,261,838 | B2 * | 9/2012 | Bullen | E21B 43/129 166/372 |
| 8,851,860 | B1 * | 10/2014 | Mail | F04B 47/02 166/105 |
| 9,638,031 | B2 * | 5/2017 | Li | E21B 21/08 |
| 9,745,975 | B2 * | 8/2017 | Dancek | E21B 43/126 |
| 9,903,187 | B2 * | 2/2018 | Robison | E21B 43/129 |
| 9,920,602 | B2 * | 3/2018 | Wang | E21B 43/122 |
| 2015/0285041 | A1 * | 10/2015 | Dancek | E21B 43/126 417/46 |

* cited by examiner

*The data of 1.75" API Rod Pump derives from *"Sucker-Rod Pumping Handbook"* (Gabor Takacs, 2015, p418-419)

HYDRAULICALLY ACTUATED DOUBLE-ACTING POSITIVE DISPLACEMENT PUMP SYSTEM FOR PRODUCING FLUIDS FROM A DEVIATED WELLBORE

BACKGROUND AND PRIOR ART

The field of this invention is the removal of fluids from wellbores using high volume and high reliability pumping or artificial lift systems. In the prior art, examples of which are cited below, it is known to use reciprocating linear pumps installed in line at the bottom end of a wellbore, attaching conduit between the pump and surface collection equipment, and powering the reciprocal motion of the pump, typically of pistons deployed within a cylinder with associated flow valve controls such as one-way valves to control fluid flow within the pump subassembly, by a series of sucker rods connected end-to-end and attached at the lowest end to the pump subassembly, and at the highest end to some mechanism such as pump jack or similar drive mechanism providing reciprocating linear motion under power from surface to the pump subassembly. The linear pumps may be a series or stages of lift pistons and packers with suitable one-way valves at each stage. These systems are time-worn, time-tested, and provide high reliability, but cannot be deployed in deviated wellbores (commonly referred to as 'horizontal wells'), due to the inability of a series of rigid interconnected rods to move linearly around the corner or bend in a deviated wellbore without impacting the well's inner wall, causing damage and wear to both casing and the rod system. Additionally, pump-jack style lift systems provide a very uneven pressure profile and relatively low and uneven flow rate of produced fluid, resulting in lower pumping volumes and inefficiencies. These pumps are very common and form part of the common general knowledge within the field of the invention.

Newer systems substitute the pump-jack with a linear hydraulic motor at surface, with associated control systems to try to even out the uneven production flow caused by uneven motor loads and mechanical connections introduced to the power strokes within the extension and contraction of the thousands of feet long rod string, whereby motor power from surface is hoped to be more effectively transferred to the downhole pump with a more finely controlled linear motor rather than the previous crude pump jack systems, or via hydraulic fluid power instead of via the rod string to transfer reciprocating linear movements, and thereby it is hoped to improve the low pumping rate and efficiency of conventional pump jack systems. An example of this may be seen in US2015/0285041 Dancek and U.S. Pat. No. 8,851,860 to Mail. In this type of improved pump system, it is the power supplied at surface to drive the same type of sucker rod pumping systems downhole which is the novelty: by using a hydraulic ram to provide reciprocating linear drive to the sucker rods, and controlling the hydraulic ram with adaptive control systems, the power profile and stroke length and cycle times can be more finely tuned with computer-based adaptive code and pressure and flow sensor information. These systems cannot be deployed in deviated wellbores, and provide for hydraulic switching valve controls at surface and not at the pump. This helps to improve the flow volume characteristics which were failings of the pump-jack prior art, and provides a well-head with no large moving parts, making it less unsightly and presumably safer for people to be around. The thousands of feet long rod string of these prior art inventions still has to reciprocate, which wastes much of the driving energy through the potentially miles long, mechanically jointed, friction-prone and connected rod string, and tons of mass of rod mechanism to supply the linear power to the downhole pump. Wellbore fluid pressures still fluctuates a large amount at each reciprocating stroke of the pump plunger's suction and discharge actions, which will disturb the filtered sands around the wellbore's screens or slotted liners, and cause those contaminants to be sucked into the pump chamber, accumulating and blocking the pump valves. In order to prevent rod friction and wear with the wellbore's inner surface or casing, the downhole pump of these inventions cannot be placed deep down in a deviated well section or in a horizontal well production zone, which means these systems may have to be supplemented with ESP systems when the well's fluid production declines.

Other systems use hydraulic pressure provided from surface equipment via conduits (spaghetti hose) to power linear movement in reciprocating linear pumps in lower sections of an associated wellbore, but are controlled by mechanically tripped or triggered switching valve gear included in the pump and actuator at the well's bottom end, or else have their switching valves at surface.

Some new systems provide for conventional submersible piston/cylinder reciprocating pump bodies powered by a downhole hydraulic cylinder actuator deployed at and above the conventional reciprocal pump, and powered by hydraulic pressure provided from surface via two conduits, switching between power fluid pressure and hydraulic fluid exhaust, with each conduit providing both functions, being switched by control gear and valve systems at surface, actuated by pressure sensing means also at surface. The pressure sensor means provides a signal when pressure in the conduit providing high pressure hydraulic power becomes elevated (inferring the end of that power stroke), in response to which the hydraulic fluid flow in the two conduits is reversed. A variety of problems arise: the equipment suffers some of the issues with the other new systems, being susceptible to water-hammer effects and power loss due to the reversal of fluid flow direction at the end of each stroke—bear in mind that the hydraulic fluid conduits are in the range of several thousands of feet in length, which is a large volume (and mass) with large inertial forces; the actuator itself will be subject to a wider range of pressures (lower low pressure regime in the side of the pump being evacuated prior to becoming supplied with pressured hydraulic fluid, higher pressure regime when the piston is at the end of a power stroke while the momentum of hydraulic fluid continues after being switched at surface but before being relieved by its associated hydraulic conduit becoming an exhaust conduit in function by switching at surface), and all fittings associated with the hydraulic lines, connections and et cetera will be subjected to large forces (larger than strictly required to power the reciprocation of the actuator's piston). Additionally, there is an inevitable timing lag between the increase in pressure at surface and the actual reversal of power fluid flow which affects the volume and pressure flow characteristics of the produced fluid in the system; further, the conventional submersible pumps and the configuration of the actuator in these systems are constrained by their relative location (order) and the inside diameter of the wellbore and production tubing at their location, meaning that the actuator being above the pump restricts the volume or cross-section of the bore through which the produced fluid must flow past the actuator. An example of this type of arrangement is found in CA 2,258,237

U.S. Pat. Nos. 6,623,252 B2, 6,004,114, and Canadian Application 2,258,237 all by Edmund C. Cunningham are a different rod-less solution for a downhole pump which can be placed in a deviated well's slanted or horizontal production section. Those new methods apply hydraulic power to drive the downhole pumps by a downhole hydraulic rotary motor or a downhole reciprocating hydraulic actuator. In those disclosures, the thousands of feet long sucker rod string is removed, and a downhole electrical motor (ESP) is replaced with a hydraulic motor or hydraulic reciprocating actuator. There are also some examples in Alberta Oil Sand CSS or SAGD wells that use hydraulic rotary motors to drive metal to metal Progressive Cavity Pumps (PCP) or multi-stage centrifugal pump systems. All of those examples have made some changes to the pump drive or power mechanism and do not make any change to the downhole pumps themselves, but either use traditional PCP pumps or conventional reciprocating pumps placed within the production tubing. These pumps' flow rate are usually small and cannot achieve the large flow rate that a similar size and diameter ESP could generate or rates which producing SAGD wells really require. The CA 2,258,237 disclosed invention will actually be a failure in use. It proposes that a double acting hydraulic submersible actuator is controlled by a ground surface valve system to reciprocate and automatically reverse a conventional downhole pump. As noted above, the hydraulic supply tubing from the surface equipment to the downhole pump will be at least a few thousand feet long for most oil wells. Such an arrangement of switching hydraulic flow direction at surface will most likely result in be a default "top dead center". In addition, as noted above, when the hydraulic actuator's piston stroke reaches one end of its travel, the surface switch will not automatically or immediately reverse the flow of thousands of feet of hydraulic fluid and the inertial energy stored in the long tubing of hydraulic fluid will continue to flow forward at the lower end of the supply tubing and into the already full pump chamber, which would cause a large pressure surge in the hydraulic actuator's one chamber. From the other actuator chamber to surface inside the hydraulic exhaust tubing, the hydraulic fluid, typically an oil, in the tubing continues to deplete, which creates a liquid column separation partial vacuum which can lead water hammer forces and deterioration of the hydraulic fluid by the partial vacuum.

It is apparent that there is a need to address at least some of the above mentioned problems of the prior art.

SUMMARY OF INVENTION

In an embodiment of this invention, the following is provided: A submersible system for lifting produced fluids from a wellbore to surface, comprising:

a. a downhole assembly
b. a conduit from surface equipment to the downhole assembly to convey pressurized hydraulic fluid from a powered hydraulic pump to the downhole assembly
c. a second conduit from the downhole assembly to the same surface equipment to convey hydraulic fluid exhausted or vented from the downhole assembly to the surface equipment
d. a production tubing to convey produced fluid from the wellbore pumped by the downhole assembly to a second set of surface equipment for collection of produced fluids, the production tubing operatively connected between a connector on the downhole assembly and the surface collection equipment.

The downhole assembly comprising:

i. a first pump section having a cylinder and included piston and with included valves and fluid passageways forming a double-action pump
ii. a linear reciprocating hydraulic actuator section having a cylinder and included piston and with included valves and fluid passageways forming a double-action linear hydraulic motor, and
iii. a second pump section having a cylinder and included piston and with included valves and fluid passageways forming a double-action pump with the pistons of each of the pumps and the actuator being connected so that they all move in the same direction and speed inside their respective cylinders; and iv. each piston's mated cylinder being formed in the annulus between the inner wall of a cylindrical portion of the outer body of the assembly and the outer surface of a second cylindrical body concentrically arranged inside the centre of the said cylindrical portion of the outer body the second cylindrical body having an internal production fluid conduit,
v. each piston being a disc with a central opening, the piston being slideably sealed to each cylindrical surface of the annular mated cylinder
vi. each mated cylinder being bounded by a wall at both of each section's ends, where adjacent cylinders may share a common wall
vii. the connection between each of the pistons also being reciprocally slideable in a linear fashion longitudinally within the assembly's body through an opening in a wall while being dynamically sealed to the wall between two sections containing the two pistons so connected
viii. each pump section's cylinder having two groups of one-way valves in conduits, the valves in conduits being in pairs, each group having multiple pairs of opposite one-way valves, one group in a chamber bounded by the section's cylinder surfaces and outer wall and one side of the included piston, the other group in a second chamber in the section's cylinder on the other side of the included piston and bounded by the other end wall, each valve pair comprising: a one-way valve permitting ingress of wellbore fluid from outside the assembly into the chamber when the piston moves to expand the volume of the chamber and denying egress of wellbore fluid when the piston moves the other direction to contract the volume of the chamber; and another opposite one-way valve denying ingress of fluid from the production fluid conduit to the chamber when the piston moves to expand the volume of the chamber and permitting egress of fluid from the chamber out to the production fluid conduit when the piston moves the other direction to contract the volume of the chamber, thus forming a double-action pump.

In this embodiment, the system has two sides, each with one pump section having one annulus cylinder and one piston, forming two independent double-action pumps with dozens of API standard V11 valves, and each pump assembly having one hydraulic actuator cylinder to simultaneously drive two pump sections of four independent double-action pumps, to pump approximately five times the wellbore fluid as conventional reciprocating API single-action rod pump of similar diameter, or to pump the same wellbore fluid volume as dozens of common API standard sucker rod pumps.

In an embodiment, the actuator's cylinder is connected with two conduits, one on each side of its piston, each such conduits also in communication with an electro-mechanical switching valve, which switching valve is also in communication with each of the power and exhaust hydraulic fluid conduits, and with a motor controller at surface electrically connected to the switching valve with at least one sensor for providing a signal to the motor controller indicating a condition which indicates an appropriate time to switch the flow of hydraulic fluid to and through the actuator between three alternatives:

1. a direct pathway which powers the actuator's piston to move in one direction,
2. a cross-over pathway which powers the actuator's piston to move in the other direction, or
3. a bypass or idle position which causes the hydraulic fluid to bypass the actuator and causes the chambers of the actuator to become sealed thus braking and holding the actuator piston in place In another embodiment, a downhole pump assembly is attached to production tubing to surface when installed and operational in a wellbore, comprising:

a. a linear reciprocating hydraulic motor
b. two linear reciprocating pumps mechanically connected to and on either side of the motor with valve-controlled fluid intakes from the wellbore and valve-controlled fluid outlets to the production tubing
c. an electromechanical switching valve with selectable direct, cross-over and bypass circuits for hydraulic fluid flow through the motor, the switch attached to the assembly and at the assembly, the switch operatively responsive to a signal from a sensor on the assembly or on a hydraulic fluid circuit between surface and the assembly, powered by a surface power source; and
d. supply and exhaust conduits for pressurized hydraulic fluid between the switch and to the actuator and surface equipment In another embodiment, the piston control sensor comprises at least one electrical limit switch at or about the location of a piston at the end of one of the pump's piston's strokes in at least one direction of the pump's linear reciprocal range of motion operatively connected to signal the piston's arrival at the location of the limit switch.

In an embodiment, the apparatus has an added one-way valve between the assembly's inner production cylinder and the production fluid conduit permitting one-way flow from the assembly toward surface, to prevent produced fluid backflow.

In a further embodiment, the apparatus may have additional powered pump section or sections with associated fluid connections, valves and sensors.

An apparatus is provided in another embodiment with surface equipment where the powered hydraulic pump's flow rate of hydraulic power fluid may be controlled and changed by operation of a variable frequency drive (VFD) motor at surface so that the downhole actuator will correspondingly change downhole pump speed.

In an embodiment of the invention, the pump equipment is provided with surface equipment including a hydraulic oil cooler which controls the cooling of the hydraulic fluid so that the working hydraulic oil can be maintained at a desirable temperature to cool and control the operating temperature of equipment in the downhole assembly, particularly in over 200° C. hot wells such as SAGD (Steam-Assisted Gravity Drainage) wells, and may have a conduit for pressurized hydraulic fluid supply and another conduit for exhaust hydraulic return between surface equipment and downhole assembly where Vacuum Isolated Tubing (VIT) or insulation is used to insulate the hydraulic fluid and prevent it from heating up in a thermal well application such as a SAGD well to maintain the working hydraulic oil in a desirable temperature range.

Another embodiment has an electric-mechanical switching valve in the downhole assembly for the hydraulic power oil direction to be intentionally tailored for flow within a hydraulic oil vent box where the downhole electrical-mechanical switching valve is enclosed and submerged and protected by clean working hydraulic oil with desirable working temperature by cooled oil and pressure isolation.

The invention may be provided with controller box at surface with a computerized Programmable Logic Controller (PLC) where all system devices, including electrical limit switches and electric-mechanical switching valve in downhole assembly in claim 1, also including a VFD motor and all temperature and pressure sensors, switches and valves located in the system, may be centrally controlled and reported on by PLC and associated interfaces.

It is to be understood that the invention as claimed is not limited by the examples or embodiments in the description, and that those skilled in the art will come to an understanding of the scope of the invention by the claims themselves.

DETAILED DESCRIPTION

Figure 1:
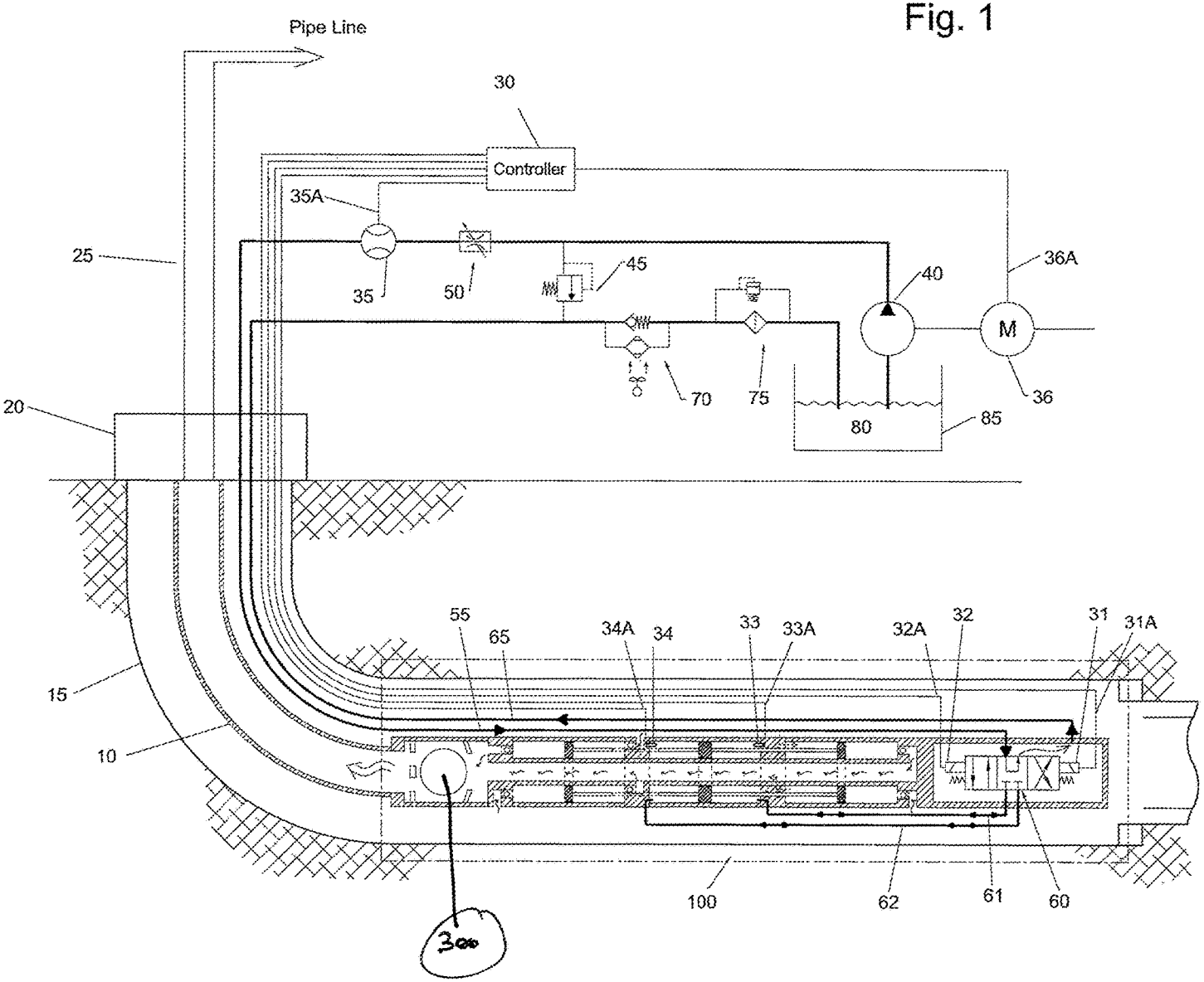
FIG. 1 is a schematic drawing representing the system and associated elements of a wellbore within which the system is installed, including surface equipment, in general terms and not to scale.
Figure 2:
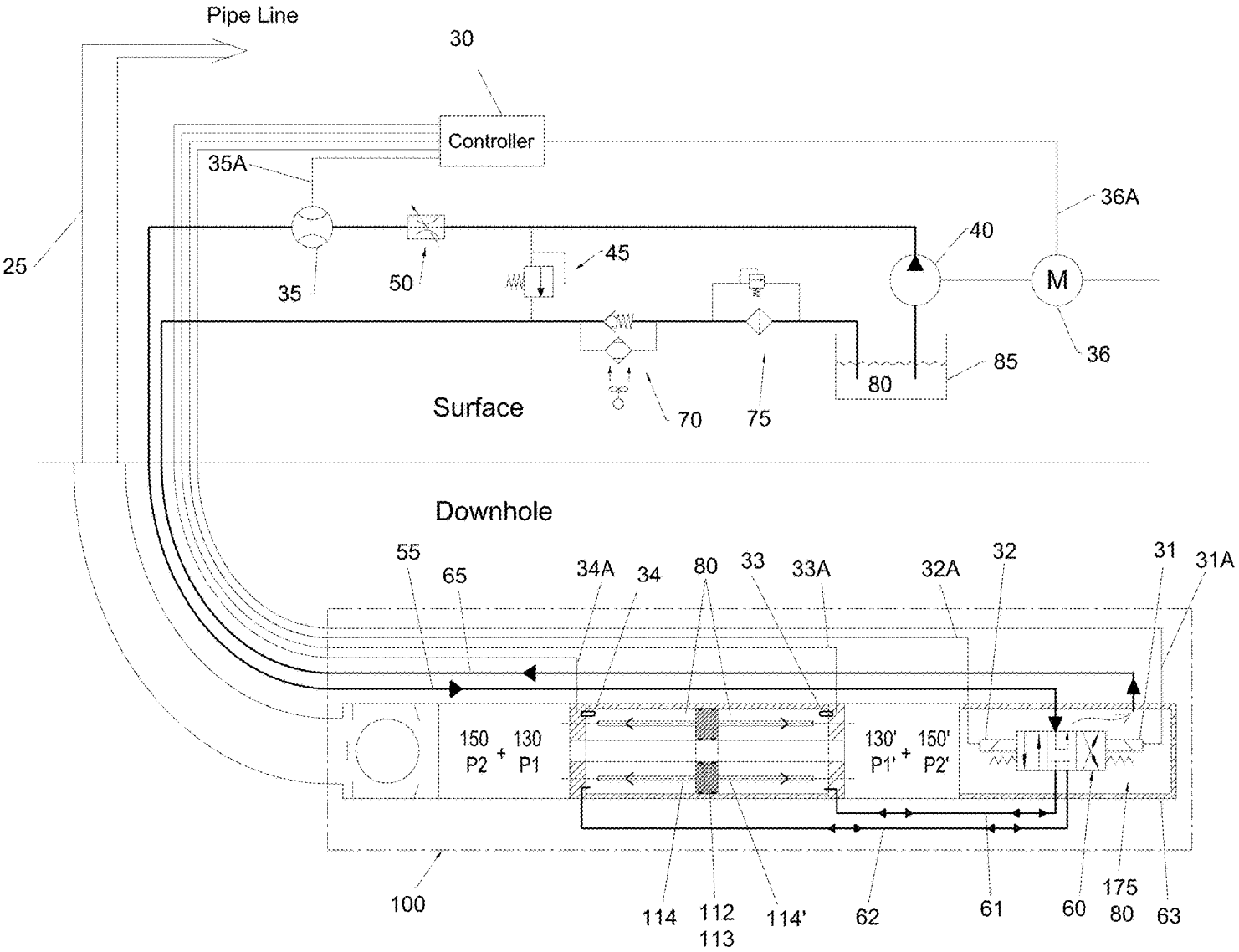
FIG. 2 is another schematic drawing focused on the switching valve and actuator and associated hydraulic fluid routes within that subsystem of the system of the invention, again not to scale.

Hydraulic power is provided by pressurized hydraulic fluid flows from surface to the downhole pump system 100. The hydraulic fluid flows in a closed loop system 55, 65 to and from surface gathering, treating and pumping equipment via a power conduit 55 to a downhole component 100 of the invention and an exhaust conduit 65 from the downhole component 100. Being in a closed system, the hydraulic fluid also is inside the actuator 110 at higher than ambient pressures while powering the actuator 110, thus lubricating and causing a pressure isolation effect to keep wellbore fluid and contaminants from the actuator's moving parts. These in-actuator pressures may be at least double the ambient wellbore pressures.

Flow of hydraulic fluid within the downhole component 100 is controlled by an electromechanical switching valve 60 at the downhole component 100 location, to direct the direction of hydraulic fluid flow to either power the pump system's linear actuator 110, preferably a double-action linear piston and cylinder type hydraulic actuator, to stroke in one direction or the opposite direction, or to bypass the actuator 110 and merely flow through the valve 60 and complete a circuit 55 from surface to and through the valve 60 at the downhole component location and back 65 to surface. The three valve 60 positions 175 may be referred to as "direct flow", "cross-over flow" and "bypass" or "idle". The "bypass" valve position isolates the actuator 110 from hydraulic fluid flow and causes the pump's pistons 135 to thereby be braked or locked in their then-current position, which is useful to avoid problems when tripping the downhole component into or out of the wellbore where pressure changes will come into play as the component is moved up or down in the well's bore.

Additionally, while in the "bypass" or "idle" position, flow of the hydraulic fluid 55 from surface to the pump 110 and back 65 becomes relatively unimpeded, permitting fast round-tripping of fresh hydraulic fluid (typically about 1½ minute per 1,000 feet travel distance) permitting use of the hydraulic fluid as a coolant to cool the downhole component, especially the electromechanical switching valve 60, as required.

The downhole component of the system comprises the hydraulic flow direction valve 60, the hydraulically powered linear actuator 110, and at least one (and preferably two) double-acting positive displacement linear piston-style pumps 150, with the actuator 110 and each pump 150 directly connected by drive connectors 114 such that movement of the actuator 110 will also move a piston 135 within every connected pump 150.

Figure 3:
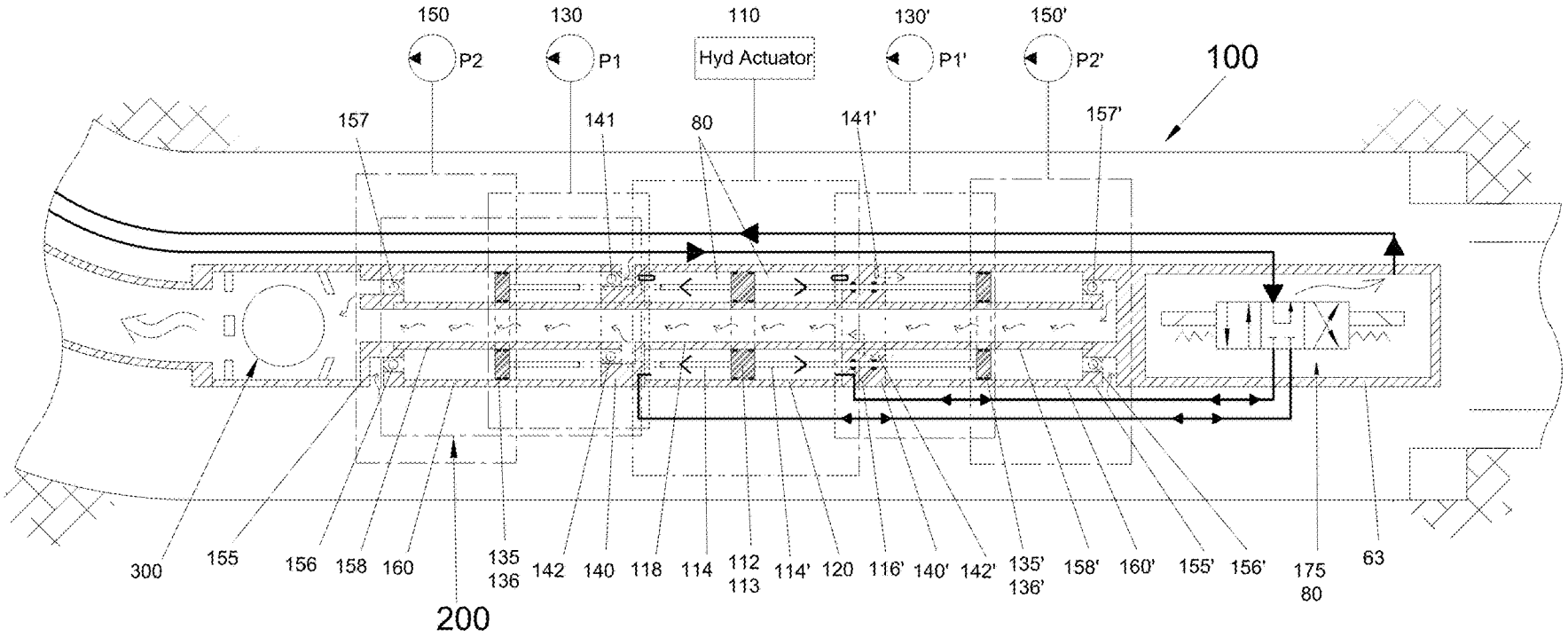
FIGS. 3, 3A and 3B are schematic drawings of the bottom hole pump, actuator, and switching valve showing fluid flow paths within the downhole component (pump, actuator, pump, switch valve) in three switch valve configurations: direct flow, cross-over flow, and idle or bypass flow. These are not to scale, but are portrayed 'same size' to permit the reader to understand the flow regimes of the invention.
Figure 3A:
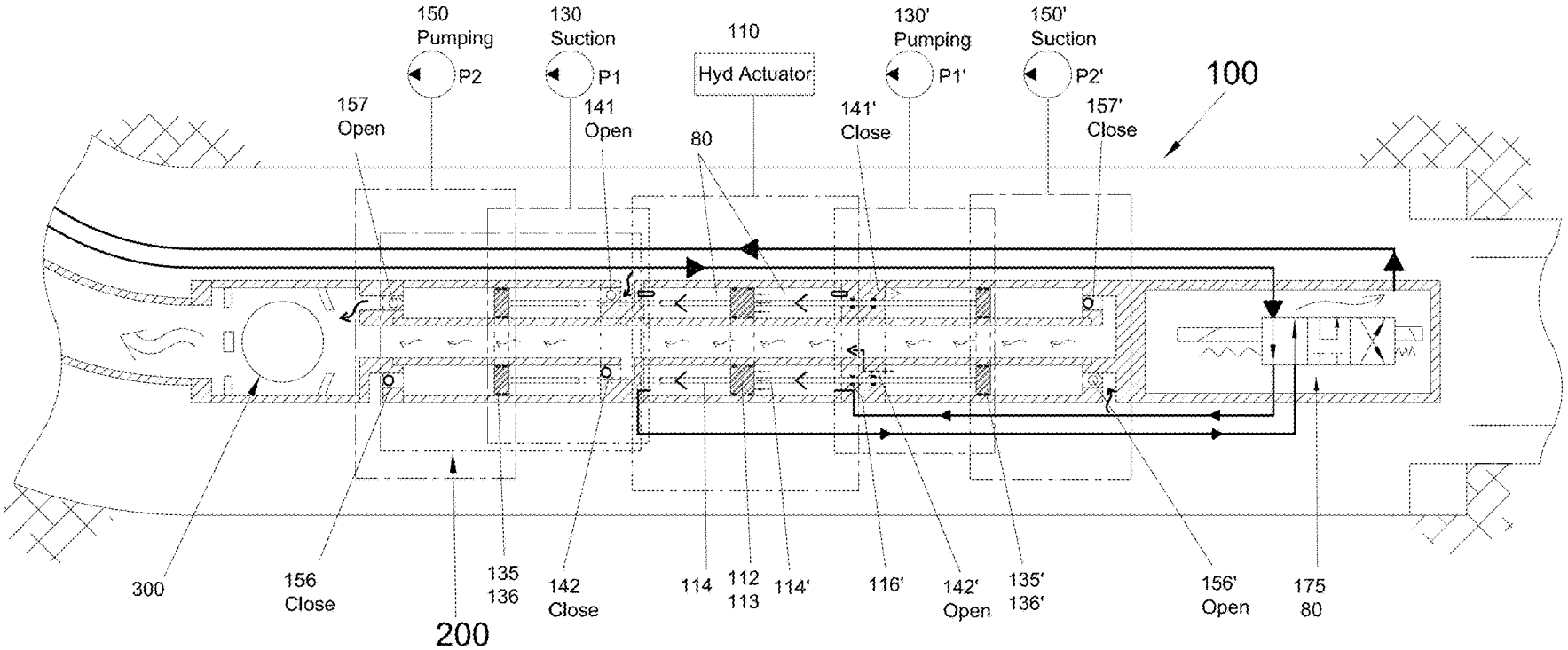
Figure 3B:
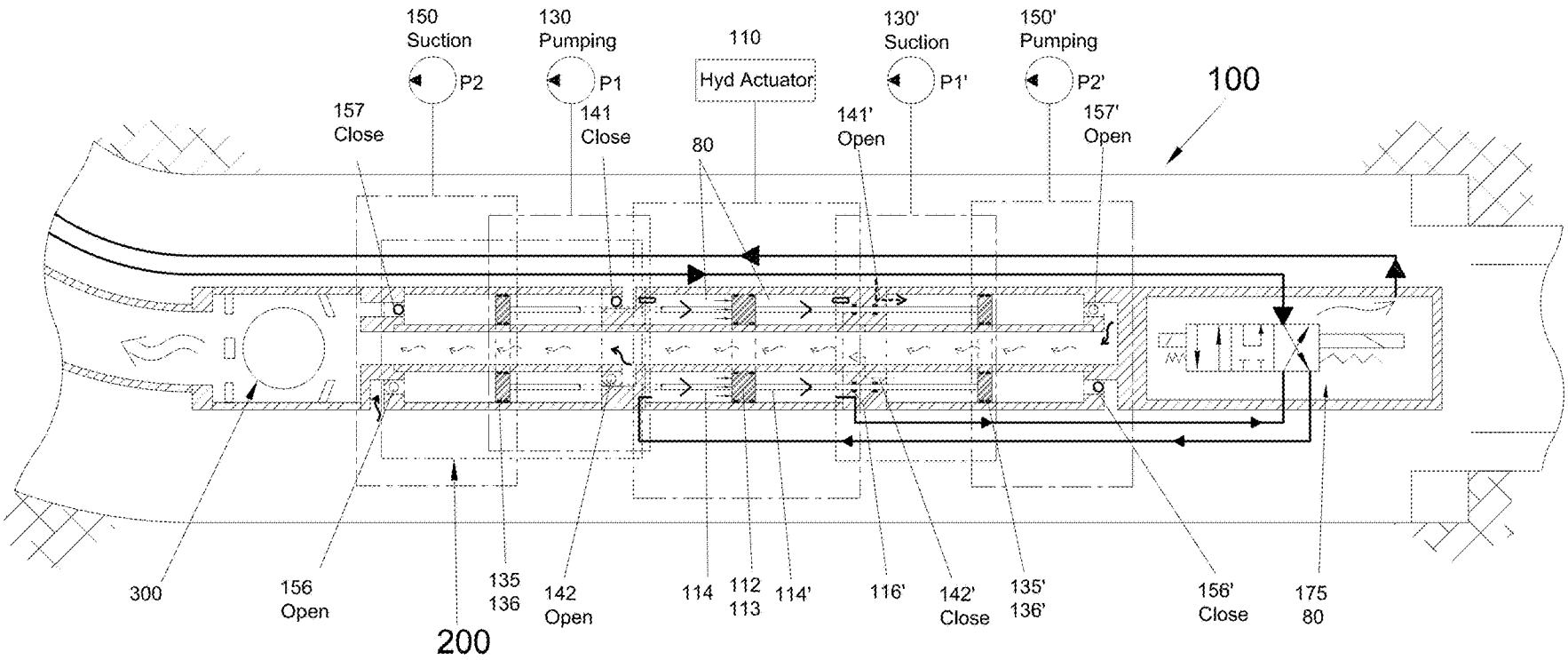
Figure 4:
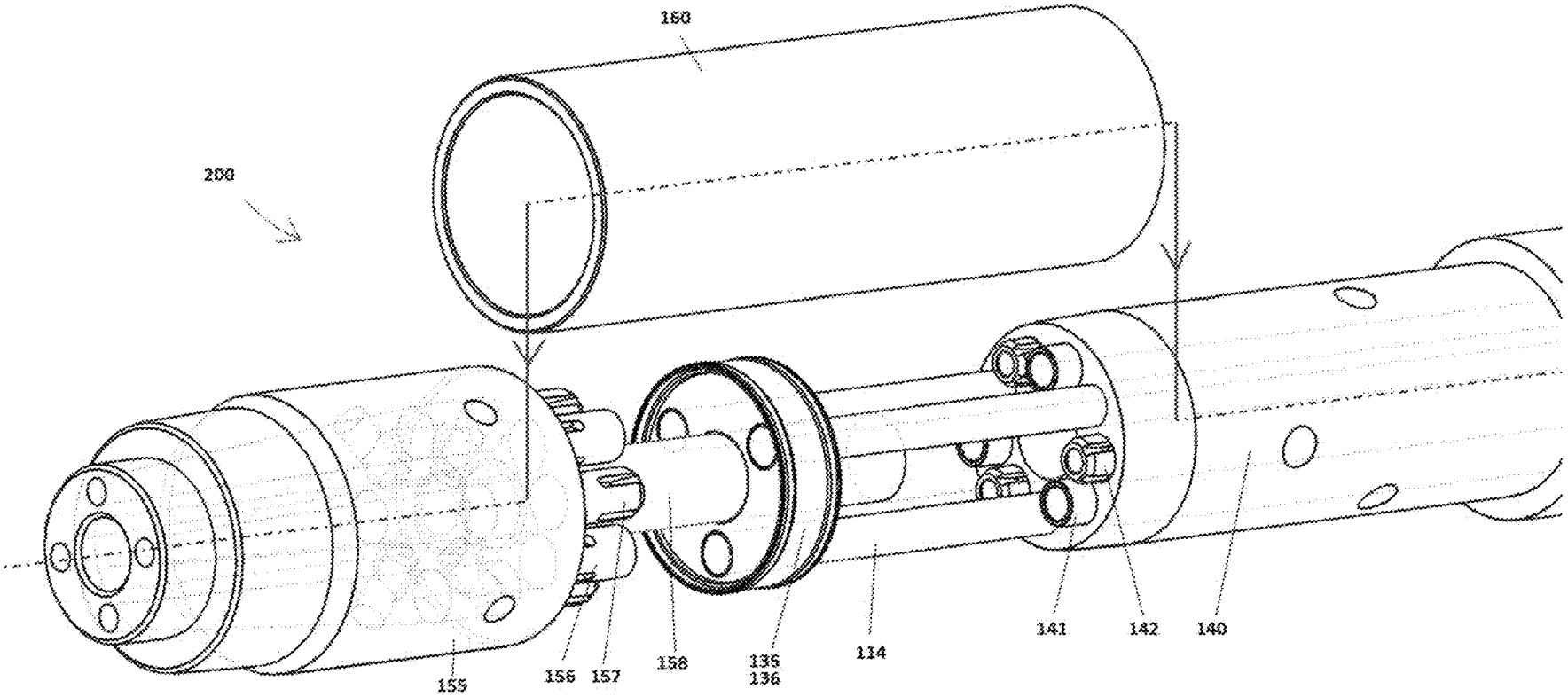
FIG. 4 is a perspective drawing of an elevation of an end of the downhole component of the system, showing the exterior wall or outer barrel of a pump section removed, to enable the reader to view and understand the location of the piston connectors, pistons, and one-way valves deployed within the pump's cylinder as well as the produced fluids cylindrical inner conduit location.
Figure 5:
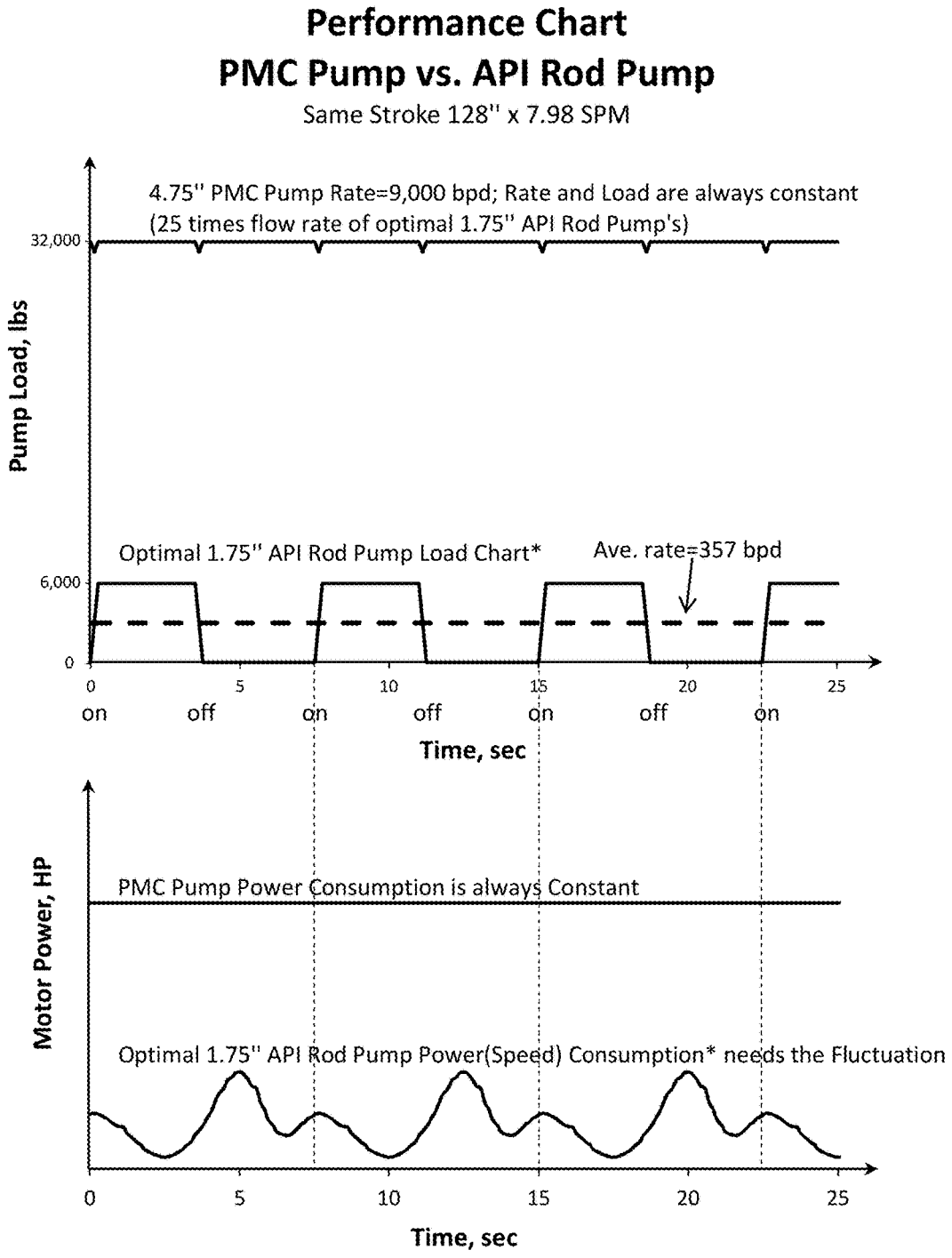
FIG. 5 is a graph or chart showing the flow rate and volume of produced fluids at comparable cycle times (linear reciprocation pump cycles) of actual conventional (API) rod-pump and of the hydraulically actuated pump system of the invention.
Figure 6:
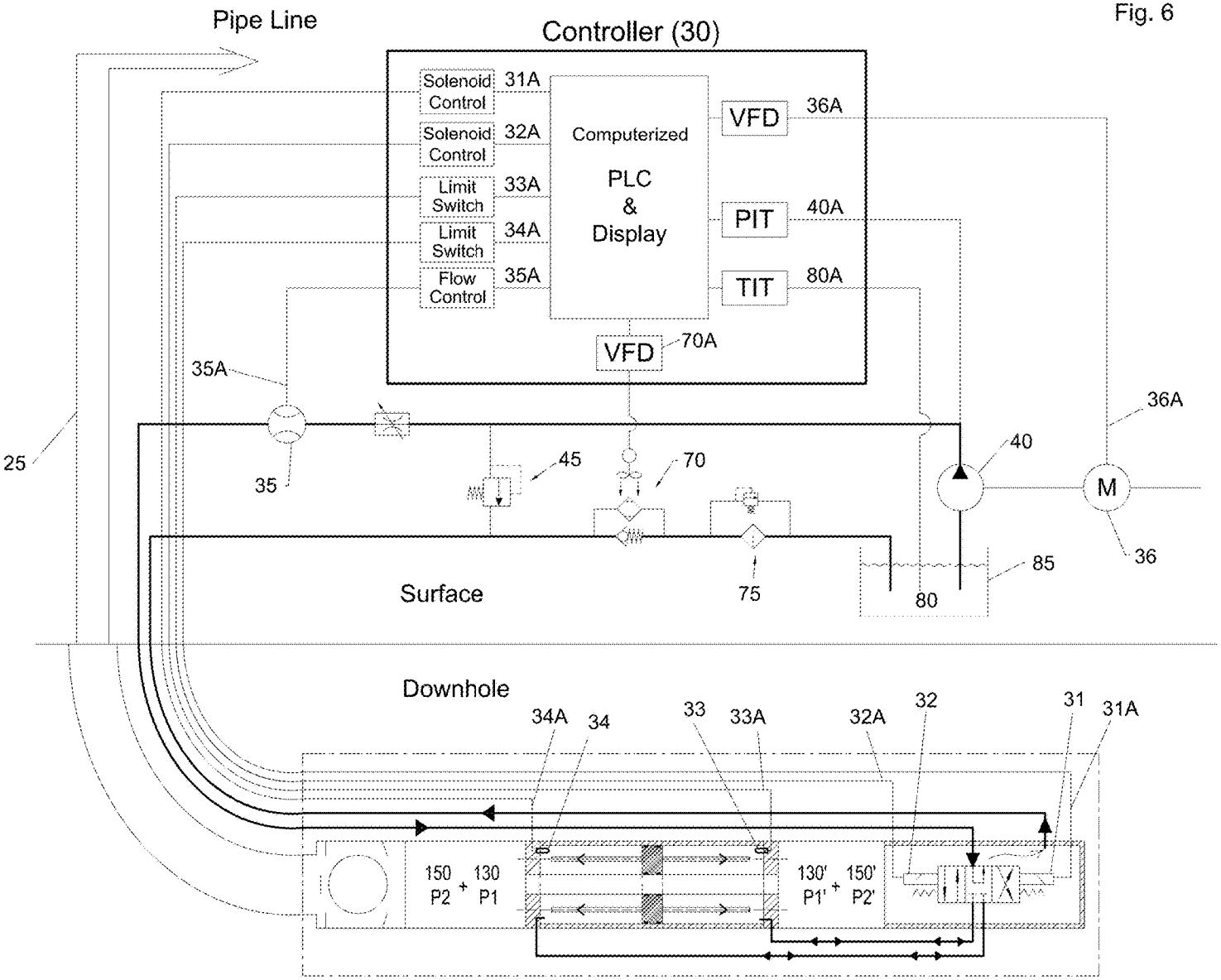
FIG. 6 is a schematic drawing representing control systems associated with the pump system, including downhole and at surface (not to scale).

In addition to the hydraulic power 55 and exhaust 65 conduits, there is also a pumped fluid conduit 10, 25 through which fluid is pumped from the wellbore at the location of the downhole component 100 up through the wellbore 15 to a desired location, preferably to fluid handling systems at surface. The fluid conduit 10, 25 should be capable of handling large volumes of produced fluid under pressures provided by the actuator 110 to the pump pistons 135. The volumes will be dependent upon the number and surface area of the pump pistons 135 and the stroke length and reciprocating frequency of the actuator 110 (and therefore of the pump piston 135). Since the pumps 150 are preferably double-acting, on each stroke (the distance travelled by the actuator 110 and each piston 135 in a direction before changing direction) the cavity defined by one end of each pump cylinder 150 and the facing side of that pump's piston 135 will act as either a chamber the contents of which are expelled under power through the pump's valves and conduits to the pumped fluid conduit 10, 25, or a chamber the contents of which are filled from the wellbore (e.g. 56 in FIG. 3A) under power through others of the pump's valves and conduits, as described below.

The electro-mechanical switching valve 60 located at the downhole equipment 100 is powered by and controlled via an electrical connection 31, 32 between itself 60 and surface equipment 30, permitting the frequency of direction change to be controlled from surface by a surface controller interface 30 with other equipment or an operator. Since the switching valve 60 is located at the downhole pump 100 at the bottom of the wellbore, the fluid in the hydraulic power conduit 55 always flows downward to the downhole actuator 110 (around 100) and the fluid in the hydraulic exhaust conduit 65 always flows upward. The flow direction of both hydraulic conduits 55, 65 never reverses, so that momentum effects on the thousands of feet of included hydraulic fluid are negligible—for instance, in systems where the hydraulic fluid is switched at the surface, when flow is stopped or its direction changed by valves at surface, the conduit which was just carrying a column of hydraulic fluid the length of the distance between the surface switching valve and a hydraulic actuator piston will undergo stresses resulting first from a stoppage of fluid flow, resulting in a drop in internal conduit pressure above the actuator, and then a surge in internal conduit pressure in the other conduit above the actuator as pressure from above collides with continued up-flow of hydraulic fluid in that conduit which was just previously under pump pressure upward. These stresses are akin to a 'water hammer' effect, and cause inordinate and unnecessary stress and strain on conduit, connectors, splices and other equipment. In that kind of hydraulic system, the hydraulic power coming from the surface source would mostly be wasted on reciprocating the thousands of feet long column of fast flowing pressure oil, and little power would be left for the oil column to power the actuator at the bottom end of the column. This is resolved in this invention by placing the switching valve 60 at the location of the downhole component 100 and its actuator 110, since the switch valve 60 never causes the change of direction of either thousands feet long hydraulic power 55 or exhaust 65 conduits between surface and the downhole components 100, but just controls the directions of two short (10-20 feet long) oil conduits 61, 62 between the switch valve 60 and the actuator 110, by which means, any "water hammer" effect can be minimized or eliminated.

While the electromechanical switching valve 60 attached to downhole pump assembly 100 can solve or eliminate the "water hammer" effect of thousands of feet long power hydraulic oil column, the environment of such a valve located at the downhole assembly location 100 may be very challenging to the electromechanical switching valve 60. This invention purposefully mounts this electro-mechanical valve assembly 60 within an included enclosure 63 which can contain the exhausted hydraulic oil from the valve 60. The design and mount will submerge this valve 60 within the always clean and temperature-controlled hydraulic oil. Therefore, this valve's 60 environmental conditions at the downhole assembly 100 can as good as it were at surface even though the actual downhole environment outside the enclosure 63 could be a multiphase mixture with liquid, gas and sand particles and with high pressure and high temperature such as in SAGD (Steam-assisted gravity drainage) production wells.

The length of the actuator 110 and pumps 150 assembly 100 will depend upon the desired length of rigid tool that the wellbore's 15 deviation can accommodate, and will depend upon the length of the stroke of the actuator 110 (and of each pump 150, which will each be the same as the actuator's). The invention as disclosed here can have any length of stroke, but the preferred range of stroke length is around 10 feet (more or less) which is similar to common or conventional sucker-rod pump equipment—this permits compatibility where required with conventional hardware and methods. It should be noted that the switching valve 60 may in fact be accomplished by a series of valves, one that cycles between close (idle or bypass) and open (to permit flow to a next valve) and a next valve in line which cycles between straight-through and cross-over hydraulic circuits (not shown separately). In this case, the bypass valve may be controlled from surface 30 while the straight/cross-over valve may be controlled locally (at the subassembly) 100. A variety of possible control circuit and valve arrangements are possible. In one embodiment, there is one switch valve (directional switch valve between straight and cross-over circuits) and two limit switches 33, 34 (for max stroke, one switch at or near the end of a stroke, assembled such that there is a limit switch at a location where a piston of the system will be near an end of its linear movement in one direction and another limit switch at the end of the linear movement of a piston—not necessarily the same piston—in the opposite direction of its stroke). These limit switches 33, 34 may be wired to surface by electrical wiring circuits 33A, 34A to a surface controller 30 which can direct the switching valve 60 downhole to either a straight-through or a cross-over position (and if equipped, to a bypass position). The control signal can be provided, depending upon the configuration of the electrical control circuits and the controller functions, from either or both of the downhole limit switches, 33, 34 or from surface controller systems 30, and can be automatic or done by manual operation. A variety of stroke lengths may be made available through feedback to the controller 30 to and from surface flow sensing and control devices, which may direct the switch 60 to change hydraulic flow circuit directions in the actuator 110 or otherwise control hydraulic fluid flow rates and power from surface 30. In order to integrate those complicated controller functions, a computerized Programmable Logic Controller (PLC) within the controller box 30 at surface equipment may be used to play a central role, where all system devices, including the electric-mechanical switching valve 60 in the downhole assembly, and electrical limit switches 33, 34 in the downhole assembly 100, also including VFD motor 70A, VFD motor 36A, and all temperature devices and pressure devices located everywhere in the whole system, may be centrally monitored and controlled and their status may be displayed responsive to the PLC 30.

By configuring the downhole component of the system 100 as a central linear actuator 110 with a double-acting pump 150 attached at each end such as in a preferred embodiment of the invention, a large-volume pumping system is provided with a relatively short overall length, which aids in utility of the invention in bent or deviated wellbores 15, where long rigid subassemblies constrain the configuration of wellbores within which the subassembly can be utilized. Shorter subassemblies are generally of greater utility, being capable of serving in a larger number of potential wellbore configurations.

In a preferred embodiment of the invention, the downhole component's 100 body is cylindrical 160 and hollow, and has a contained second cylinder the inside of which forms a cylindrical pumped fluid passageway 158 through its body centred (in cross-section) and extending within three adjacent sections of the component's body: a first pump section 155, an actuator section 110, and a second pump section 140. Within each of the three sections is deployed a piston 135, each of which is slideably fit and dynamically sealed to the inner surface of the cylindrical body 156, 160, 140 and to the outer surface of the second cylinder 158, thus forming an annular piston surface on each side of each piston 135. Each piston is connected, so that when the piston within the actuator system moves, both pump pistons move an equal distance in the same direction; the connection is preferably by three rods 114 connecting the piston 135 in the first pump 155 section to the actuator piston 110, which is in turn connected to the second pump piston 135, 140. Segregating the three sections are annular walls (near 141, 142): a first wall at the outside end of the first pump section, a second wall at the inside end of the first pump section, the piston-side of the first and second walls and the inner surface of the cylindrical body and the outer surface of the second cylinder defining the first pump cylinder; a third wall at the inside end of the actuator section, the actuator side of the second and third walls and the inner surface of the cylindrical body and the outer surface of the second cylinder defining the actuator 110 cylinder; a fourth wall at the furthest end of the second pump section from the actuator, the pump piston-side of the third wall, the piston-side of the fourth wall, and the inner surface of the cylindrical body and the outer surface of the second cylinder defining the second pump cylinder. The connecting rods 114 extend through and are attached to each piston 135, and also extend through each wall in a slideably sealed configuration, permitting the rods to move in a linear reciprocating fashion within holes in the walls while dynamically sealed to permit the walls to act as barriers to form the various pistons' cylinders.

Each pump section operates in a similar fashion: as the actuator 110 piston moves, the connections between the actuator piston force the pump piston 135 in the same direction, moving the piston within the pump cylinder. In one direction, the set of one-way valves 156, 157 permits wellbore fluid to flow into a first chamber of the pump cylinder, the chamber which expands as the piston moves within the cylinder, as the chamber expands, and at the same time, the second set of one-way valves 141, 142 in a second chamber on the opposite side of the same piston in the same cylinder opens to permit wellbore fluid from that second chamber to be forced into the pumped fluid passageway 158 and from there into the pumped fluid conduit 10 toward surface. Of course, there are other one-way valves which are closed during this stroke but open during the reverse stroke of the actuator and pistons, these other one-way valves when open would be in communication from the first chamber to the pumped fluid passageway and in communication from the second chamber to the wellbore. During the opposite stroke, the first and second chamber functions would reverse with the reversal of the linear direction of the actuator and connected pistons. Another one-way valve 300 may be positioned within the connection between the downhole component's central pumped fluid conduit and the pumped fluid passageway, to control backward flow or pressure from fluid in that passageway from affecting the pressures within the pump(s).

The actuator 110, during the same exemplary stroke, is configured as follows: a first conduit from the switching valve 60 to a first chamber of the actuator section 110 is placed into fluid communication with the hydraulic fluid power supply conduit 55 and a second conduit from the switching valve 60 to a second chamber of the actuator section 110 is placed into fluid communication with the hydraulic fluid exhaust conduit 65, via one configuration of the switching valve 60—for ease of reference and this example, the "direct flow" configuration. The first chamber of the actuator 110 section is formed of the volume in the annulus between the pumped fluid conduit's outer surface and the downhole component's body's inner surface and one side of the actuator piston 112, while the second chamber is formed of the volume within the actuator section's cylinder on the other side of the actuator's piston 112. The hydraulic fluid power supply 55 introduced to the first actuator chamber forces the piston 112 in a direction, moving the piston and its connected equipment, and pushing hydraulic fluid previously in the second chamber into the hydraulic fluid exhaust conduit 65, both via passages in the downhole component in communication between each chamber and the switching valve 60. The actuator piston can thus be powered to linear movement in a reciprocating motion, thus powering the pump(s) 150. At the end of each stroke of the actuator piston 112, the piston's motion can be caused to change by switching the switch valve 60 appropriately, in this example from "direct flow" to "cross-over flow" configurations. A pause position would typically be only used for circulating hydraulic fluid within the long power and exhaust conduits between surface and downhole components before the pump starts to work, or to cool the downhole components 100 particularly the electro-mechanical valve 60. Once the pump starts to work, the idle pause position would not typically be used in order to keep both long hydraulic conduits flowing in their respective single direction and to prevent the "water hammer" effect. In some circumstances, a pause cycle, stroke frequencies and stroke lengths can be controlled by controlling the flow volume or hydraulic flow switching valve 60, and this might be done responsive to fluid flow rates in any of the various conduits 55, 65, 25 of the system, measured at surface 30 or at the downhole equipment 100. The actuator 110 may preferably be equipped with one or more limit switch 33, 34 to directly sense when the piston 112 is at a particular point in its stroke, preferably when near to or adjacent either wall of the actuator's cylinder, and the signal from a limit switch 33, 34 at or near to either wall may be used to control the switching valve 60 in order to reduce piston-wall collisions by limiting the piston stroke.

The produced fluid 25 flow rate can be simply decided and controlled by a surface hydraulic pump's 40 (typically a common gear pump) flow rate. When the surface hydraulic pump 40 sends pressurized hydraulic fluid 55 at a higher flow rate, the produced wellbore fluid 25 will be pumped out to surface facilities (not shown) at a higher rate. The surface hydraulic pump's 40 flow rate can be easily controlled by commonly available VFD (Verified Frequency Drive) inside the control box 30 and with a related electrical motor.

The produced volume of the pump system is much greater than, and the pump flow rate is more even and constant and without any significant interruption or fluctuation, than the volume of produced wellbore fluid in prior art reciprocating linear pump systems, in particular those switched at surface or powered by strings of rods or mechanical linkages from drive equipment at surface, where the flow characteristics of those prior systems are always intermittent (e.g. pump jack systems). For example, one 4.75" pump of the design of this invention can provide equivalent production fluid flow of two dozen 1.75" conventional sucker-rod style pumps.

Of note, there are very few moving parts to the assembly of this invention downhole 100, making it very reliable. The mass of the driven parts is very low, thus requiring little energy to change the system's linear direction during reciprocating cycles. The parts that do move are sealed across a small area (the piston edges 112, 135, for instance) providing very low friction in operational movement of the parts. The one-way valves 141, 142, 300 are very simple, and can be very high reliability ball-type valves. If the connection between the actuator section 110 and one pump section 150 becomes disconnected, the actuator 110 may still pump production fluid with a pump 150 on the other side of the assembly. Due to the concentric arrangement of the production fluid conduit 158 within the centre of the body of the assembly and the pistons, the surface area of each piston 135 can be large in comparison to the outside diameter of the assembly, which must fit within the wellbore 10 to be used—this provides more power from the actuator's piston and larger displacement of each stroke of each piston. By switching the hydraulic fluid flow path locally at the downhole assembly 60, there is very little mass which must be reciprocated (for instance, none of the hydraulic fluid in the closed system 55, 65 above the switch needs to change direction during any pump reciprocation cycle), which provides high efficiency use of power per unit of pumped production fluid volume. The arrangement of double-acting pumps 150 on either side of the hydraulic actuator 110, and the configuration of the pumps' chambers, is automatically very balanced, with a very stable and non-fluctuating flow rate (volume and pressure profile), which reduces wasted motion of parts or subcomponents and connectors and conduits and external tubing and equipment—forces are very evenly applied and used, without irregular surges, which provides for less wear and strain on equipment and components. Stable flow rates from the formation into the assembly, as well as stable flow rates from the assembly 100 to surface, provide less stress on both the formation and the equipment associated with the wellbore and production of fluid to surface. High flow rates and high pressures can be provided by the system's pumps 150, and the overall diameter and length of the downhole assembly 100 is conducive to deviated wellbores 10, 15. The system provides the ability to cool the downhole assembly 100 with hydraulic fluid flowed from surface 55 in the system both while working and when at an idle or bypass setting (at the switching valve) 60. The pressured hydraulic fluid 55 powers the pumped wellbore fluid 25. At same time the working hydraulic fluid 55 continuously cycles from surface into the downhole assembly then back 65 to surface. This self-cooling feature has the consequence that the working hydraulic fluid is simultaneously cooled and filtered at the surface equipment. This built-in feature is especially useful in high temperature wellbores such as are common in SAGD wells, in which case the operator may use Vacuum Insulated Tubing (VIT) and other insulated tubing such as PTFE tubing can be used to prevent hydraulic working fluid in the conduits to be heated up by the hot wellbore environment. The isolation of the actuator piston 112 and cylinder from wellbore fluids by keeping that segment of the assembly bathed in high pressure hydraulic fluid which is continuously cooled and cleaned at surface means that the power characteristics of the actuator 110 will be quite stable and not susceptible to outside contaminants, resulting in longer wear and less expensive componentry requirements. The hydraulic actuator 110 will have a much longer service life and be far less susceptible to failure caused by downhole environments such as high temperatures and pressures which are harmful to electric motors used in Electric Submersible Pump (ESP) systems in deviated well and SAGD situations. Progressive cavity motor and pump systems are not as efficient or reliable as the reciprocating linear motor and pumps of this invention. ESP's are typically rotating power driving centrifugal pump stages, which are not as efficient or reliable as linear systems, and which operate at far higher speeds with respect to the moving parts, making the higher speed movements (in the ESP in the order of 3500 rpm or even higher) more damaging if unbalanced, and more wearing on bearings if rotating while in a deviated (from vertical) posture when in use (such as in a bent or deviated well) or if the long assembly of stages of rotating sub-parts (in the order of 500-1000 inches) is itself deformed or deviated during injection into a deviated wellbore. The length of assembly required to provide sufficient lift using multi-stage centrifugal pumps is much longer than the length required for this invention's assembly to lift an equivalent volume of fluid an equal distance. Additionally, the electric motors of ESP systems while being susceptible to high temperatures, generate their own heat downhole with no method of self-cooling particularly in the case where the wellbore environment is hot as well.

A table of parts and reference numbers matched to the drawings follows:

Electrical Control System:

30 electrical control box
31, 31A solenoid control one direction of valve and its cable
32, 32A solenoid control another direction of valve and its cable
33, 33A limit switch one direction
34, 34A limit switch another direction
35, 35A flow meter and its cable
36, 36A Primary Mover and its cable Hydraulic Power System:

40 primary Hydraulic Displacement Pump
45 bypass valve
50 flow control valve
55 hydraulic power supply tubing (high pressure)
60 hydraulic power directional valve
61 hydraulic power supply and oil vent tubing for one chamber of downhole pump actuator
62 hydraulic power supply and oil vent tubing for another chamber of downhole pump actuator
63 oil vent box for hydraulic power directional valve
65 hydraulic oil vent tubing
70 Hydraulic oil cooler
75 hydraulic oil filter
80 hydraulic of reservoir
85 hydraulic oil tank Well Bore Fluid Pumping System

100 horizontal well bore section
110 single Hydraulic Actuator for four groups of Downhole Pumps
112, 113 hydraulic actuator piston and seal
114,114' actuator rods for four groups of Downhole Pumps
116,116' actuator rod seals
118 inner barrel of hydraulic actuator
120 outer barrel of hydraulic actuator
130 P1 group pumps
130' P1' group pumps
135,136 pump plunger (or piston) and its seals for P1 group pumps and P2 group pumps
135',136' pump plunger (or piston) and its seals for P1' group pumps and P2' group pumps
140 valve seat for P1 group pumps
141 fluid suction valves for P1 group pumps
142 fluid pumping valves for P1 group pumps
140' valve seat for P1' group pumps
141' fluid suction valves for P1' group pumps
142' fluid pumping valves for P1' group pumps
150 P2 group pumps
155 valve seats for P2 group pumps
156 fluid suction valves for P2 group pumps
157 fluid pumping valves for P2 group pumps
150' P2' group pumps
155' valve seats for P2' group pumps
156' fluid suction valves for P2' group pumps
157' fluid pumping valves for P2' group pumps
158 inner barrel for P1 group pumps and P2 group pumps
160 outer barrel for P1 group pumps and P2 group pumps
158' inner barrel for P1' group pumps and P2' group pumps
160' outer barrel for P1' group pumps and P2' group pumps
175 hyd power directional valve combo
300 discharge valve for all groups of pumps
10 well fluid producing tubing
15 wellbore casing
20 wellhead
25 oil pipeline

The invention claimed is:

1. A submersible system for lifting produced fluids from a wellbore to surface, comprising:

a. a downhole assembly, b. a conduit from surface equipment to the downhole assembly to convey pressurized hydraulic fluid from a powered hydraulic pump to the downhole assembly, c. a second conduit from the downhole assembly to the same surface equipment to convey hydraulic fluid exhausted or vented from the downhole assembly to the surface equipment, d. a production tubing to convey produced fluid from the wellbore pumped by the downhole assembly to a second set of surface equipment for collection of produced fluids, the production tubing operatively connected between a connector on the downhole assembly and the surface collection equipment, e. the downhole assembly comprising:

i. a first pump section having a cylinder and included piston and with included valves and fluid passageways forming a double-action pump, ii. a linear reciprocating hydraulic actuator section having a cylinder and included piston and with included valves and fluid passageways forming a double-action linear hydraulic motor, and, iii. a second pump section having a cylinder and included piston and with included valves and fluid passageways forming a double-action pump with the pistons of each of the pumps and the actuator being connected so that they all move in the same direction and speed inside their respective cylinders;

iv. each piston's mated cylinder being formed in the annulus between the inner wall of a cylindrical portion of the outer body of the assembly and the outer surface of a second cylindrical body concentrically arranged inside the centre of the said cylindrical portion of the outer body the second cylindrical body having an internal production fluid conduit, v. each piston being a disc with a central opening, the piston being slideably sealed to each cylindrical surface of the annular mated cylinder, vi. each mated cylinder being bounded by a wall at both of each section's ends, where adjacent cylinders may share a common wall, vii. the connection between each of the pistons also being reciprocally slideable in a linear fashion longitudinally within the assembly's body through an opening in a wall while being dynamically sealed to the wall between two sections containing the two pistons so connected, viii. each pump section's cylinder having two groups of one-way valves in conduits, the valves in conduits being in pairs, each group having multiple pairs of opposite one-way valves, one group in a chamber bounded by the section's cylinder surfaces and outer wall and one side of the included piston, the other group in a second chamber in the section's cylinder on the other side of the included piston and bounded by the other end wall, each valve pair comprising: a one-way valve permitting ingress of wellbore fluid from outside the assembly into the chamber when the piston moves to expand the volume of the chamber and denying egress of wellbore fluid when the piston moves the other direction to contract the volume of the chamber; and another opposite one-way valve denying ingress of fluid from the production fluid conduit to the chamber when the piston moves to expand the volume of the chamber and permitting egress of fluid from the chamber out to the production fluid conduit when the piston moves the other direction to contract the volume of the chamber, thus forming a double-action pump, with one pump section having one annulus cylinder and one piston, forming two independent double-action pumps with a plurality of valves, and each pump assembly having one hydraulic actuator cylinder to simultaneously drive two pump sections of four independent double-action pumps, ix. the actuator's cylinder connected with two conduits, one on each side of its piston, each such conduits also in communication with an electro-mechanical switching valve, which switching valve is also in communication with each of the power and exhaust hydraulic fluid conduits, x. a motor controller at surface electrically connected to the switching valve, xi. at least one sensor for providing a signal to the motor controller indicating a condition which indicates an appropriate time to switch the flow of hydraulic fluid to and through the actuator between three alternatives:

1. a direct pathway which powers the actuator's piston to move in one direction,
2. a cross-over pathway which powers the actuator's piston to move in the other direction, or
3. a bypass or idle position which causes the hydraulic fluid to bypass the actuator and causes the chambers of the actuator to become sealed thus braking and holding the actuator piston in place.

2. The apparatus of claim 1 where the sensor comprises at least one electrical limit switch at or about the location of a piston at the end of one of the pump's piston's strokes in at least one direction of the pump's linear reciprocal range of motion operatively connected to signal the piston's arrival at the location of the limit switch.

3. The apparatus of claim 1 with an added one-way valve between the assembly's inner production cylinder and the production fluid conduit permitting one-way flow from the assembly toward surface.

4. The apparatus of claim 1 with an additional powered pump section or sections with associated fluid connections, valves and sensors.

5. The apparatus of claim 1 having surface equipment where the powered hydraulic pump's flow rate of hydraulic power fluid may be controlled and changed by operation of a variable frequency drive (VFD) motor at surface so that the downhole actuator will correspondingly change downhole pump speed.

6. The apparatus of claim 1 having surface equipment including a hydraulic oil cooler which controls the cooling of the hydraulic fluid so that the working hydraulic oil can be maintained at a desirable temperature to cool and control the operating temperature of equipment in the downhole assembly.

7. The apparatus of claim 1 having one conduit for pressurized hydraulic fluid supply and another conduit for exhaust hydraulic return between surface equipment and downhole assembly where insulated tubing or conduit, or Vacuum Isolated Tubing (VIT) may be used for at least the power fluid conduit to insulate the hydraulic fluid and prevent it from heating up in a thermal well application.

8. The apparatus of claim 1 having an electric-mechanical switching valve in the downhole assembly for the hydraulic power oil direction to be intentionally tailored for flow within a hydraulic oil vent box where the downhole electrical-mechanical switching valve is enclosed and submerged and protected by clean working hydraulic oil with desirable working temperature by cooled oil and pressure isolation.

9. The apparatus of claim 2 having a controller box at surface equipment with a computerized Programmable Logic Controller (PLC) where all system devices, including electrical limit switches and electric-mechanical switching valve in downhole assembly in claim 1, also including a VFD motor and all temperature and pressure sensors, switches and valves located in the system, may be centrally controlled and reported on by PLC and associated interfaces.

10. The apparatus of claim 6, wherein the surface equipment comprises an over 200° C. hot well.

11. The apparatus of claim 10, wherein the hot well is an SAGD (Steam-Assisted Gravity Drainage) well.

* * * * *